US005658407A

United States Patent [19]

Thorbjörnsson

[11] Patent Number: 5,658,407

[45] Date of Patent: Aug. 19, 1997

[54] METHOD AND APPARATUS FOR PRE-PRESSING FIBROUS MATERIALS DURING THE MANUFACTURE OF FIBERBOARD MATERIALS

[75] Inventor: Sven-Ingvar Thorbjörnsson, Karlstad, Sweden

[73] Assignee: Sunds Defibrator Industries AB, Sweden

[21] Appl. No.: 535,204

[22] PCT Filed: Mar. 30, 1994

[86] PCT No.: PCT/SE94/00287

§ 371 Date: Nov. 6, 1995

§ 102(e) Date: Nov. 6, 1995

[87] PCT Pub. No.: WO94/26488

PCT Pub. Date: Nov. 24, 1994

[30] Foreign Application Priority Data

May 6, 1993 [SE] Sweden ..... 9301554

[51] Int. Cl.[6] ..... D21J 1/04

[52] U.S. Cl. ..... 156/62.2; 156/583.5; 156/555; 264/109; 425/371

[58] Field of Search ..... 264/109; 156/62.2, 156/555, 583.5; 425/371

[56] References Cited

U.S. PATENT DOCUMENTS 3,885,901 5/1975 Reiners .
4,271,105 6/1981 de Mets et al. .
4,420,357 12/1983 Neubauer et al. ..... 156/583.5

FOREIGN PATENT DOCUMENTS 35 39 364 A1 5/1987 Germany .

*Primary Examiner*—Michael W. Ball
*Assistant Examiner*—Sam Chuan Yao
*Attorney, Agent, or Firm*—Lerner, David, Littenberg, Krumholz & Mentlik

[57] ABSTRACT

A method for pre-pressing webs of lignocellulose-containing fibrous material is disclosed including forming the predetermined density, further compressing the mat without the addition of heat to a density approximating that of the predetermined density, and feeding the compressed mat to the finishing press while permiting the controlled expansion of the mat. Apparatus for pre-pressing the web of lignocellulose-containing fibrous material prior to the finishing press is also disclosed.

10 Claims, 2 Drawing Sheets

METHOD AND APPARATUS FOR PRE-PRESSING FIBROUS MATERIALS DURING THE MANUFACTURE OF FIBERBOARD MATERIALS

FIELD OF THE INVENTION

The present invention relates to a method and apparatus for pre-pressing a mat formed from disintegrated lignocellulose-containing fibrous material prior to its final pressing during the continuous manufacture of board, such as fiberboard and particle board.

BACKGROUND OF THE INVENTION

Fiberboard is normally manufactured in the form of MDF (Medium Density Fiberboard). This material is a board product which is based on wood, and which in recent years has been used to a rapidly increasing extent. MDF is to be understood here as comprising fiberboard with a varying density, and which is manufactured according to the dry method. MDF is made from wood fibers, which are dried, glued, formed and pressed in a hot press in a known manner. Almost without exception the thus-formed fiber web or mat is a so-called single-layer board, i.e. it has a substantially homogeneous structure with uniform fiber distribution, uniform moisture content, and uniform glue addition across its thickness. The relatively dry surface layer of fluff fibers is thus exposed to both radiant heat and contact heat in the hot inlet to the hot press, which is normally a continuous press.

Particle board is manufactured in a similar way, and is now primarily built up as so-called triple-layer board, i.e. it comprises a central layer of coarse chips and two surface layers of fine chips. These layers are manufactured separately and, therefor, it is also possible to select different moisture contents and glue contents in the various layers. During the manufacture of particle board the surface layer is also exposed to the press heat, but is not dried out with the same intensity, because of the higher moisture content in the surface layers, and because of the more compact nature of the chip material.

During the manufacture of board of these and similar types, as mentioned, a web or mat is formed which is pre-pressed and possibly pre-heated prior to its being fed into the hot press, where the pressing is carried out at a controlled surface pressure and/or thickness at a temperature of between about 150° and 230° C. and where conventional urea formaldehyde glues are used. (Other glues are also used, especially at higher board densities). In order to bring about the necessary board properties, a continuous press is required which is flexible, and at which, among other things, a high surface pressure can be applied at an early stage in the press. This implies at the same time, that the thickness of the mat, even at this early stage, is very close to the final pressed thickness, i.e. the mat thickness must be reduced very substantially in the press inlet.

In order to ensure that such a reduction in thickness takes place without destroying or attenuating the surface layers of the mat, the inlet portion must be long and preferably wedge-shaped, so as to provide the time required for air enclosed in the mat to be transported out of the mat in a gentle way. Such an inlet, however, causes the surface layer to be substantially heated and dried out at a location where the surface pressures required for compressing the mat are still very low. With this method, therefore, the surface particles become dried out, and therefore the glue also dries out and is inactivated, which results in an unsatisfactory hardness and strength of the surface layer. As a result, the surface layer obtained is often called a pre-hardening layer, because the glue therein has hardened and/or been dried out before sufficient surface pressures have arisen to bring about good contact between the fibers or particles. This surface layer must then be ground in a later production step, and therefore constitutes a substantial loss of raw material and a substantial increase in handling.

It should also be mentioned in this connection that the press temperature at the beginning of the press cycle, i.e. in the inlet portion (compression portion) of the press should be as high as possible in order to soften the surface layer as rapidly as possible when surface pressure has been applied, and in order to obtain the highest possible heat penetration rate into the board. This desire is therefore in direct conflict with the complex problem of pre-hardening.

Another factor which promotes the increase of pre-hardening is the fact that the known continuous presses are provided with endless conveying belts made of steel, and these belts require a large radius of curvature, generally on the magnitude of about 800 to 1000 mm, which renders heating in the inlet unavoidable.

On the other hand, when pre-hardening is to be minimized, the aim must be to compress the mat as quickly as possible to a sufficient surface pressure for good bonding. With known designs of continuous presses it is possible to reduce pre-hardening to some extent, but there is instead the risk of attenuations and surface cracks arising in the surface material, because enclosed air, which must be pressed out rapidly, causes an over-pressure to arise in the mat. Such faults may only be discovered, however, at a much later date. Such surface cracks, for example, often can pass unnoticed through the process of board production, and it is only when the board is to be painted by the customer that the surface cracks are found to have caused variations in the surface density, resulting in varying paint absorption or suction, and thus a varying glaze. Without exception, this gives rise to complaints.

SUMMARY OF THE INVENTION

According to the present invention, methods and apparatus have been provided for solving these problems, and at the same time yielding additional advantages. In accordance with the present method and apparatus, the pre-hardening layer, for example, can be minimized or even prevented and the evacuation of air takes place more gently.

In accordance with one aspect of the present invention, a method is provided for pre-pressing a web of lignocellulose-containing fibrous material comprising forming the lignocellulose-containing material into a mat by compressing the lignocellulose-containing fibrous material in a first compression step to form a compressed mat having a predetermined density, expanding said compressed mat, further compressing the compressed mat without the addition of heat to form a further compressed mat having a density approximating the predetermined density, and feeding the further compressed mat to a finishing press for final pressing while permitting the controlled expansion of the further compressed mat.

In accordance with one embodiment of the method of the present invention, the method includes feeding the further compressed mat to the finishing press while permitting the further compressed mat to expand by a factor of between about 5 and 15% of the thickness thereof.

In accordance with another embodiment of the method of the present invention, the finishing press is intended to provide a finished product having a predetermined finished thickness, and the method includes feeding the further compressed mat to the finishing press at a thickness of between about 1.3 and 2 times the predetermined finished thickness.

In accordance with another embodiment of the method of the present invention, the method includes further compressing the compressed mat to form a further compressed mat at a density slightly less than the predetermined density.

In accordance with another embodiment of the method of the present invention, the method includes feeding the further compressed mat to the finishing press at an angle of less than about 15°.

In accordance with another aspect of the present invention, apparatus is provided for pre-pressing a web of lignocellulose-containing fibrous material prior to the finishing press comprising forming means for forming the lignocellulose-containing fibrous material into a mat having a predetermined density, and permitting said mat to expand first compressing means for compressing the mat of lignocellulose-containing fibrous material, the first compressing means comprising upper and lower endless belts forming a converging inlet portion free of heating means for heating the compressed mat and nip roller means for further compressing the compressed mat without the addition of heat to form a further compressed mat having a density approximating the predetermined density, and delivery means for delivering the further compressed mat to the finishing press.

In accordance with one embodiment of the apparatus of the present invention, the delivery means includes feeding means for feeding the compressed mat to the finishing press while permitting the controlled expansion of the further compressed mat.

In accordance with another embodiment of the apparatus of the present invention, the feeding means feeds the further compressed mat to the finishing press while permitting the further compressed mat to expand by a factor of between about 5 and 15% of the thickness thereof.

In accordance with another embodiment of the apparatus of the present invention, the finishing press is intended to provide a finished product having a predetermined finished thickness, and the feeding means delivers the further compressed mat to the finishing press at a thickness of between about 1.3 and 2 times the predetermined finished thickness.

In accordance with the present invention, there is thus accomplished a successive re-compression of the fibrous mat which has initially been compressed and expanded in connection with the formation thereof, and is carried out without the addition of heat. The mat can then be introduced as far as practically possible into the inlet portion of the hot press where it is finally transferred to the hot surfaces in the hot press, and in this manner high surface pressures can be applied immediately with minimum pre-hardening of the surface layers thereof.

BRIEF DESCRIPTION OF THE DRAWINGS

The invention can be more fully understood with reference to the following detailed description, which refers to the drawings in which.

DETAILED DESCRIPTION

Figure 1:
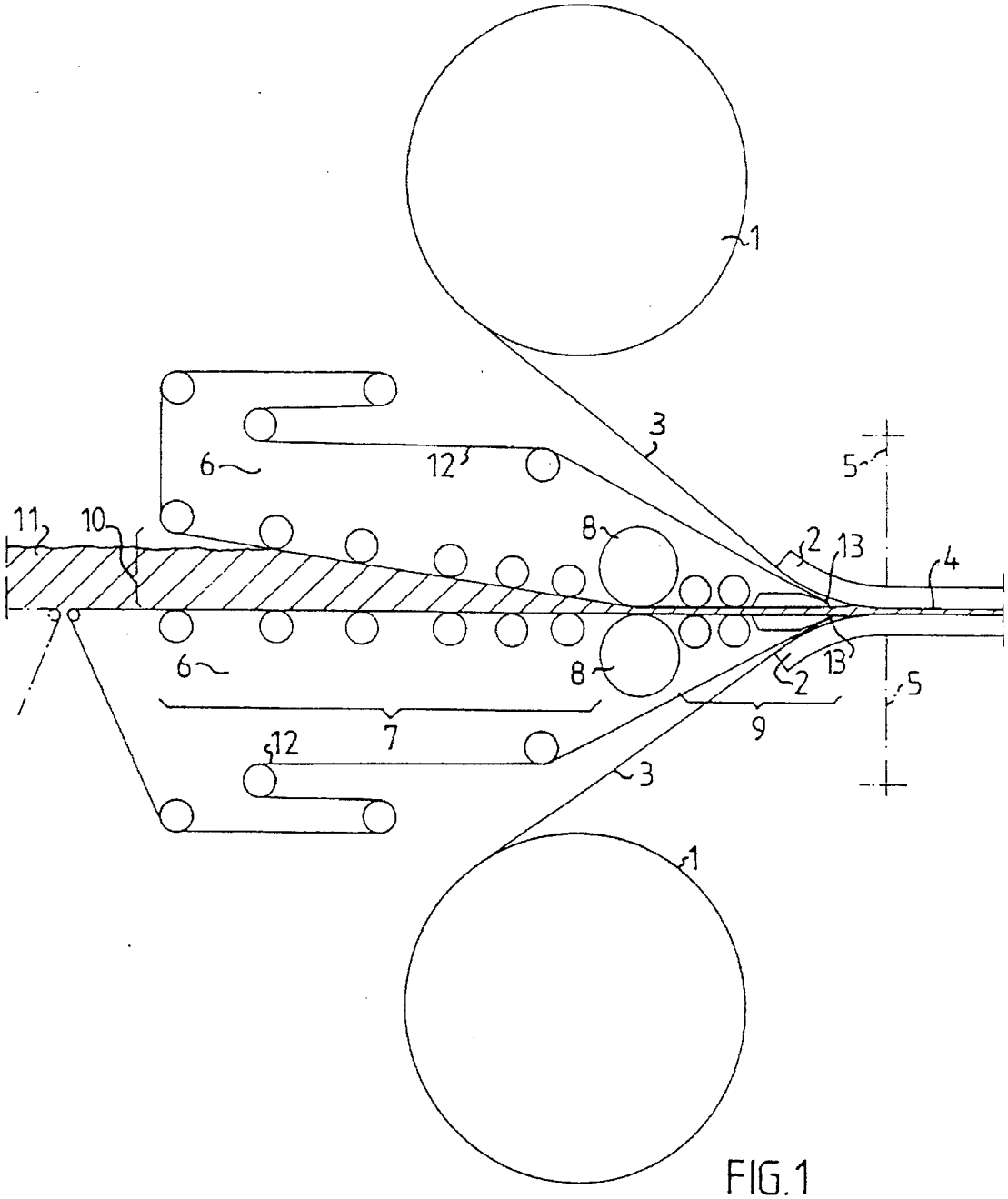
FIG. 1 is a side, schematic view of the apparatus and method of the present invention.

Referring to the Figures, the inlet portion of a continuous hot press as shown in the Figures is designed in a known manner with front guide rollers 1 and heating plates 2, which are formed with an inlet radius of the same magnitude as the radius of the guide rollers 1, and thereafter transform to a substantially parallel portion 4. The distance between the heating plates 2 can only be varied to a small degree in relation to the distance at the inlet radius. A steel belt 3 is stretched over guide rollers and drive rollers and slides or rolls to the heating plates in a known manner. The transition between the inlet portion and parallel portion 4 is marked by the center line 5.

In the inlet portion of this apparatus, the pre-pressing arrangement according to the present invention is located. This arrangement comprises three main parts: a converging inlet and compression portion 7, one or several nip roll pairs 8, and a slightly diverging delivery portion 9. The inlet opening 10 of the inlet portion is adjustable in some suitable manner, either automatically or manually, so it can be adapted to the height of the incoming mat 11. Thus, in combination with a suitable length of the inlet portion 7, the pressing of air out of the mat 11 can take place in a gentle way, and without the risk of damage. A suitable load is applied to the upper nip roll 8, which is movable in the vertical direction, so that the desired compression of the mat is effected. It is expedient at this point to compress the mat to a density close to and preferably immediately below the density achieved during the previous compression after the forming operation. Such a re-compression requires a relatively moderate load. The load is preferably applied by air cylinders, hydraulic cylinders or the like. The end of the inlet portion 7 closest to the upper nip roll 8 is preferably coupled together mechanically with the nip roll so as to follow the vertical movement of the nip roll.

In the subsequent diverging delivery portion 9 the mat expands slightly, by a magnitude of about 5 to 15%, which substantially reduces the power required for holding the mat in a compressed state. This portion can thus be dimensioned moderately. The ends of the delivery portion 9 closest to the nip rolls 8 are also coupled together mechanically with their respective nip rolls.

The mat 11 is transported through the apparatus between two endless belts 12, which can be solid, air permeable or formed as wires. In the inlet portion 7 the belts are supported on rolls and/or sliding surfaces. At the outlet end of the delivery portion 9 the belts are turned over a small radius 13 formed as a sliding nose or as rollers.

The belts 12 are driven and guided in a known manner. If it is deemed suitable in view of the forces acting on the belts in the inlet portion 7 and the nip 8, stronger inner belts can be used.

Figure 2:
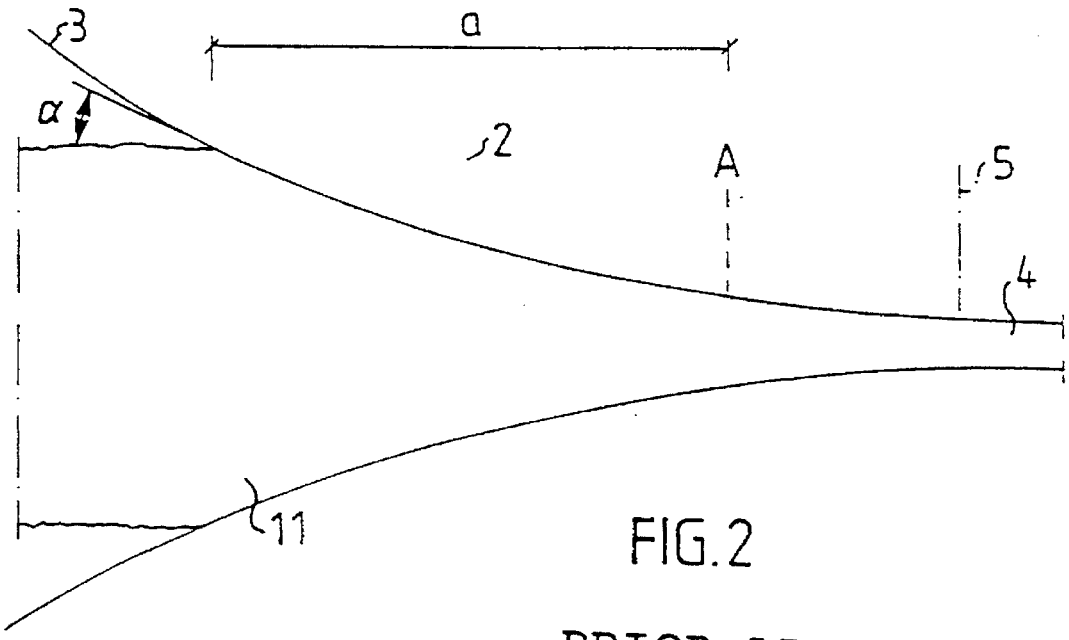
FIG. 2 PRIOR ART
FIG. 2 is an enlarged, sectional, schematic view of the feed area to a hot press according to a conventional design.

A conventional design is shown in FIG. 2. During the manufacture of 19 mm board (net) a normally pre-pressed fiber mat for the hot press is assumed to be about 160 mm thick. Without the proposed invention, the mat is compressed from 160 mm to about 25 mm in the inlet nip of the hot press. The surface pressure at A in FIG. 2 is assumed to have increased to a level at which good bonds between the fibers and particles can be obtained with the hardening of the glue. The thickness at this point is assumed to be about 50% greater than in the inlet nip. The distance from the mat contact to A is designated by a.

Figure 3:
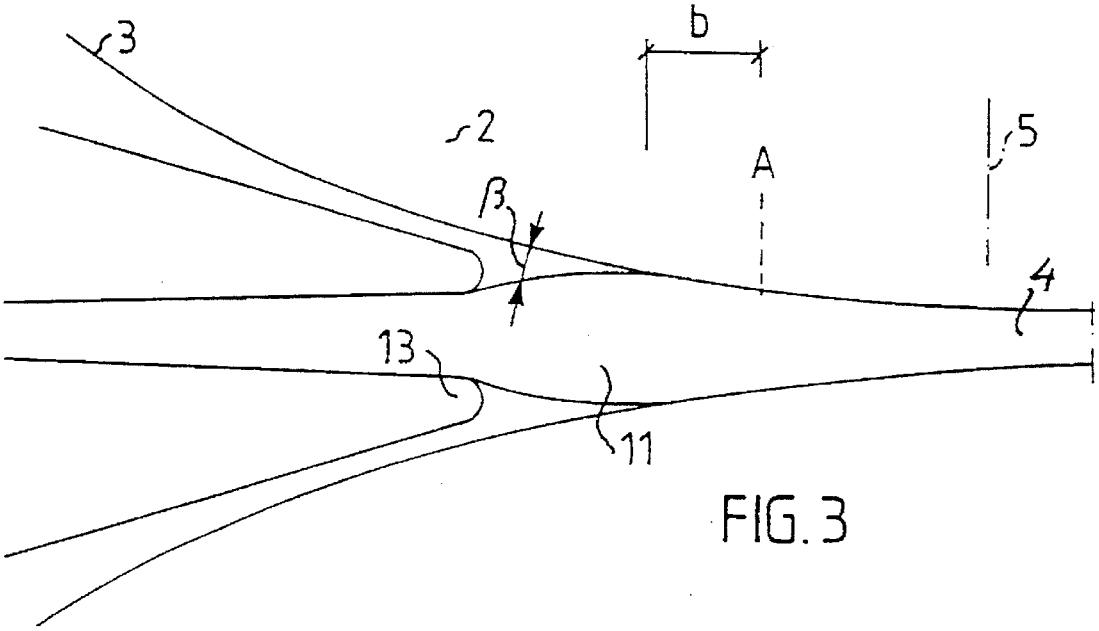
FIG. 3 is a side, enlarged, schematic view of the feed area to the hot press in accordance with the method and apparatus of the present invention.

A design according to the present invention is shown in FIG. 3. In this case the mat has been re-compressed to a high density in the inlet, and expands slightly before being passed into the inlet of the hot press. The distance from the point of mat contact to A in FIG. 3 is designated by b. At the entrance into the inlet of the hot press the thickness of the mat is preferably about 1.3 to 2 times the thickness of the finished board. With normal designs of the inlet portion in the hot press, the distance b can be reduced by the present invention to a fraction of a. Typical values are of the magnitude of between about 10 and 30%. The pre-hardening decreases thereby approximately to a corresponding extent. It is thus also possible to increase the steel belt temperature. Additionally, the mat is not exposed to radiant heat from the hot upper belt before contacting the mat, whereby pre-hardening is also reduced.

The angle at which the steel belt meets the mat is a measure of the compression rate of the mat. It is understood from FIGS. 2 and 3 that the angle $\alpha$ is more than twice the magnitude of the angle $\beta$, which should be less than about 15°, preferably less than about 10°. It is also easily understood that the amount of air to be evacuated is about 3 to 4 times greater in FIG. 2 when compared with FIG. 3. The result of all of this is that the risk of surface cracks and attenuation has been substantially reduced by the present invention, as shown in FIG. 3.

During the manufacture of board materials of normal thicknesses in continuous presses, for example at thickness of about 19 mm, thickness tolerances downstream of the finishing press of about ±0.15 mm are often obtained, which is normally sufficient to sell these boards in an unground condition. Owing to the pre-hardening of the surfaces, however, pressing must take place at a nominal thickness of about 20.2 mm. This excess in size must therefore be reduced by grinding, i.e. the result is a direct production loss of raw material (wood, glue, and wax), drying energy, and grinding energy, of about 6 to 7%, plus the total cost of the grinding operation. Elimination of pre-hardening, can thus result in an essential saving, which pays for the investment involved in the present invention in a short time.

Another essential advantage of the present invention is that the surface layers are hard and lead to less paint absorption, while maintaining a bright surface. (In contrast to the case where water is sprayed through nozzles onto the surfaces prior to pressing).

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

I claim:

1. A method for pre-pressing a web lignocellulose-containing fibrous material prior to a final pressing into a board comprising compressing said web lignocellulose-containing fibrous material in a first compression step to form a compressed mat having a predetermined density, expanding said compressed mat to form an expanded mat, further compressing said expanded mat without the addition of heat to form a further compressed mat having a density approximating said predetermined density, and feeding said further compressed mat directly to finishing press for said final pressing while maintaining compression of said further compressed mat and simultaneously permitting the controlled expansion of said further compressed mat.

2. The method of claim 1 comprising feeding said further compressed mat to said finishing press while permitting said further compressed mat to expand by a factor of between about 5 and 15% of the thickness thereof.

3. The method of claim 1 wherein said finishing press is intended to provide a finished product having a predetermined finished thickness, said method including feeding said further compressed mat to said finishing press at a thickness of between about 1.3 and 2 times said predetermined finished thickness.

4. The method of claim 1 comprising further compressing said compressed mat to form a further compressed mat having a density slightly less than said predetermined density.

5. The method of claim 1 wherein said finishing press includes a steel belt for feeding said further compressed mat to said finishing press, and including feeding said further compressed mat to said finishing press at an angle of less than about 15° with respect to said steel belt.

6. Apparatus for pre-pressing a web of lignocellulose-containing fibrous material prior to a finishing press comprising first compression means for compressing said lignocellulose-containing material so as to form said lignocellulose-containing material into a mat having a predetermined density and permitting said mat to expand, further compressing means for further compressing said expanded mat of lignocellulose-containing fibrous material, said further compressing means comprising upper and lower endless belts forming a converging inlet portion free of heating means for heating said compresssed mat and nip roller means for further compressing said expanded mat without the addition of heat to form a further expanded mat having a density approximating said predetermined density, and delivery means for delivering said further compressed mat directly to said finishing press while permitting controlled expansion thereof.

7. The apparatus of claim 6 wherein said delivery means permits the controlled expansion of said further compressed mat.

8. The apparatus of claim 7 wherein said delivery means permits the controlled expansion of said further compressed mat by a factor of between about 5 and 15% of the thickness thereof.

9. The apparatus of claim 6 wherein said finishing press is intended to provide a finished product having a predetermined finished thickness, and wherein said delivery means delivers said further compressed mat to said finishing press at a thickness of between about 1.3 and 2 times said predetermined finished thickness.

10. A method for pre-processing a web of lignocellulose-containing fibrous material prior to a final pressing into a board comprising compressing said web of lignocellulose-containing fibrous material in a first compression step to form a compressed mat having a predetermined density, further compressing said compressed mat without the addition of heat to form a further compressed mat having a density slightly less than said predetermined density, and feeding said further compressed mat to a finishing press for said final pressing while permitting the controlled expansion of said further compressed mat.

* * * * *

UNITED STATES PATENT AND TRADEMARK OFFICE

CERTIFICATE OF CORRECTION

PATENT NO. : 5,658,407

DATED : August 19, 1997

INVENTOR(S) : Sven-Ingvar Thorbjörnsson

It is certified that error appears in the above-identified patent and that said Letters Patent is hereby corrected as shown below:

On the title page, item

[57] ABSTRACT, line 3, after "the" (first occurrence), insert --fibrous material into a mat, compressing the mat to a--;
line 6, "permiting" should read --permitting--.

Signed and Sealed this

Twenty-fifth Day of November, 1997

Bruce Lehman

*Attest:*

BRUCE LEHMAN

*Attesting Officer*

*Commissioner of Patents and Trademarks*